US005386683A

United States Patent [19]

Misrachi

[11] Patent Number: 5,386,683

[45] Date of Patent: Feb. 7, 1995

[54] METHOD FOR MAKING A WIRE ROPE HAVING A PLASTIC JACKETED CORE WITH WORMINGS

[75] Inventor: Joe Misrachi, Côte St. Luc, Canada

[73] Assignee: Wire Rope Industries Limited, Pointe-Claire, Canada

[21] Appl. No.: 156,042

[22] Filed: Nov. 23, 1993

Related U.S. Application Data

[63] Continuation-in-part of Ser. No. 873,190, Apr. 24, 1992, abandoned.

[51] Int. Cl.[6] ..... D02G 3/36; D07B 1/06

[52] U.S. Cl. ..... 57/003; 57/222; 57/223

[58] Field of Search ..... 57/210, 212, 217, 222, 57/223, 3, 6, 362, 902

[56] References Cited

U.S. PATENT DOCUMENTS

| | | | |
|---|---|---|---|
| 2,276,042 | 3/1942 | Jacobson | 57/222 |
| 3,018,607 | 1/1962 | Dietz et al. | 57/215 X |
| 3,705,489 | 12/1972 | Smollinger | 57/149 |
| 4,166,355 | 9/1979 | Gross | 57/212 |
| 4,509,319 | 4/1985 | Yoshida et al. | 57/215 X |
| 5,044,722 | 9/1991 | Voser | 385/113 |

FOREIGN PATENT DOCUMENTS

| | | | |
|---|---|---|---|
| 1163879 | 3/1984 | Canada . | |
| 2219014 | 11/1989 | United Kingdom | 57/219 |

*Primary Examiner*—Daniel P. Stodola
*Assistant Examiner*—William Stryjewski
*Attorney, Agent, or Firm*—Keck, Mahin & Cate

[57] ABSTRACT

A method for making a wire rope comprising a core; a plastic jacket placed over the core; a plurality of outer strands laid on the circumference of the jacket core; and a plurality of substantially round wormings. The method comprises the steps of: i) extruding the plastic jacket over the core; ii) simultaneously laying on the circumference of the jacketed core a plurality of loose and substantially round wormings, and a plurality of outer stands, whereby the wormings are compressed by the outer strands to substantially fill the voids comprised between two adjacent outer strands and the core.

8 Claims, 1 Drawing Sheet

METHOD FOR MAKING A WIRE ROPE HAVING A PLASTIC JACKETED CORE WITH WORMINGS

RELATED APPLICATION

This is a continuation-in-part application of application Ser. No. 07/873,190, filed Apr. 24, 1992, now abandoned.

FIELD OF THE INVENTION

The present invention relates to a method for making wire ropes having plastic jacketed cores.

BACKGROUND OF THE INVENTION

It is known to provide a plastic jacket around the core of wire ropes such as disclosed, for example, in U.S. Pat. No. 3,705,489 granted Dec. 12, 1972. The primary function of such jacket is to prevent metal to metal contact between the core and the outer strands wound on the core and also to space away the outer strands by forcing the outer strands into the jacket. Another function of the jacket is to prevent escape of the lubricant that is normally placed in the core to decrease the friction between the components of the core and thus increase the life of the wire rope.

In the manufacture of large diameter cable, it became very difficult to adequately compress the outer rope strands into a thick core plastic jacket so as to displace jacket material into the voids formed between the strands and the core so as to space the outer strands. Because of this, the large diameter wire ropes were made slightly oversize but, when the outer strands became fully embedded into the core jacket during the first hours of operation, they tended to loop out.

SUMMARY OF THE INVENTION

According to the present invention, there is now provided a method for making a wire rope comprising a core; a plastic jacket placed over the core; a plurality of outer strands laid on the circumference of said jacketed core; and a plurality of substantially round wormings, the method comprising the steps of:

i) extruding the plastic jacket over the core;

ii) simultaneously laying on the circumference of the jacketed core a plurality of loose and substantially round wormings, and a plurality of outer strands, whereby the wormings are compressed by the outer strands to substantially fill the voids comprised between two adjacent outer strands and the core.

In a preferred embodiment, the thickness of the jacket is from 0.035" to 0.060".

DETAILED DESCRIPTION OF THE INVENTION

Figure 1:
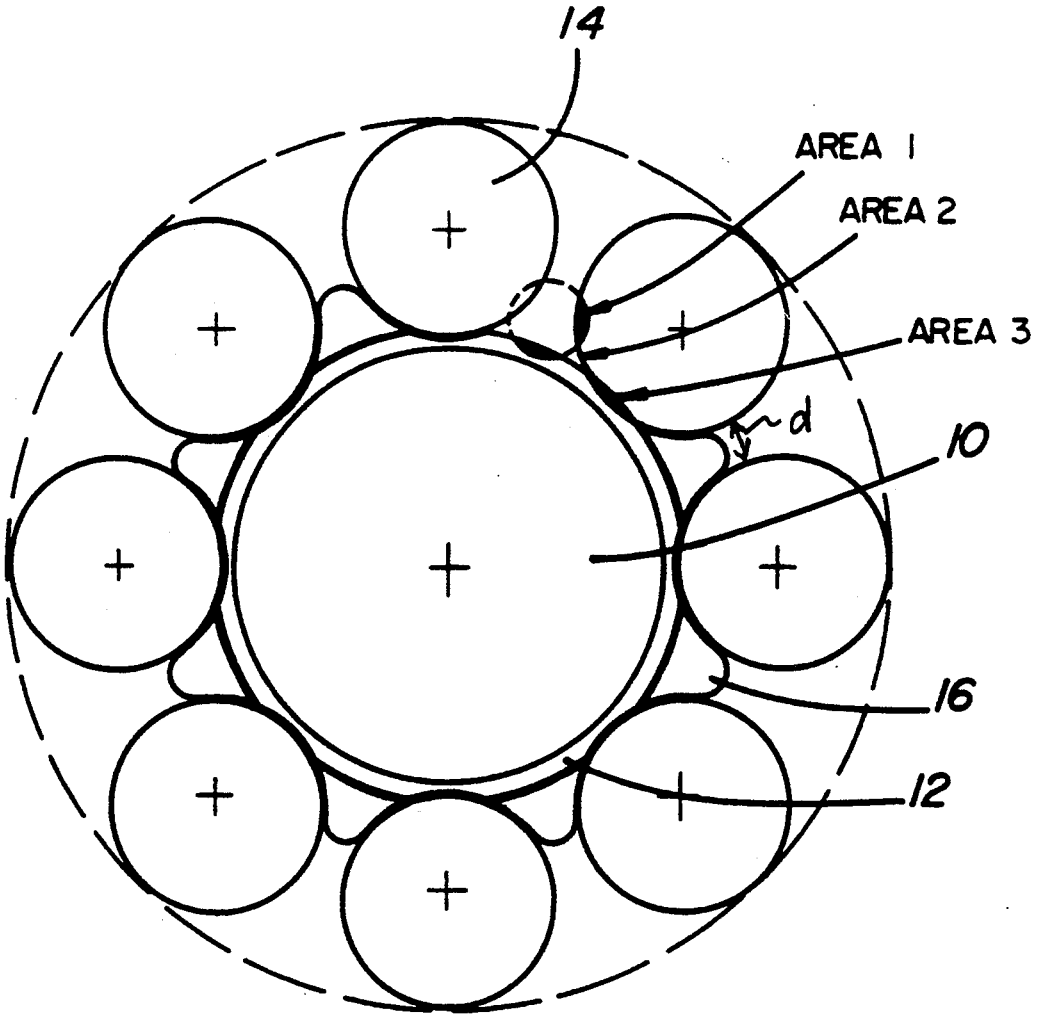

The applicant has surprisingly found that all the advantages of a plastic jacketed core may be achieved with a combination of a thin jacket between 0.035" and 0.060" over the core and substantially round wormings placed in the voids formed between the outer strands and the core during closing of the outer strands on the jacketed core.

The wormings are loosely laid on the core simultaneously with the outer strands. The wormings are compressed by the outer strands so as to fill the voids comprised between two adjacent outer stands and the core. They are also sized so that the ratio between their compressed cross-sectional area and the void area formed between a strand, a worming and the core is from 0.5 to 3.

The wormings are preferably made of fibrous material such as nylon but can be made of plastic rods of suitable hardness, including plastic rods impregnated with lubricants.

IN THE DRAWING

The FIGURE shows a schematic cross-sectional view of a wire rope made by the method of the present invention.

The wire rope has a lubricated core 10. The core may be an independent wire rope core (IWRC), a wire strand core, or a fibre core. A plastic jacket 12 having a thickness between 0.035" and 0.060" is extruded over the core. The plastic material of the jacket can be polyethylene, polypropylene, nylon or another suitable thermoplastic material including a plastic material impregnated with lubricant. The function of the core jacket is to encapsulate the core lubricant and to protect the core from abrasion and contact loads applied by the outer strands.

A plurality of outer strands 14 are laid on the circumference of the jacketed core 10. A plurality of substantially round wormings 16 are also laid loosely on the circumference of the core between the outer strands. The wormings are laid on the core at the same time as the outer strands. They are compressed by the outer strands in such a way as to substantially fill the voids comprised by two adjacent outer strands and the core. They are also sized so as to satisfy the following ratio:

$$R = \frac{\text{AREA 1} + \frac{1}{2}\text{AREA 3}}{\text{AREA 2}} = 0.5 \text{ to } 3$$

wherein

AREA 1 = compressed worming cross-section shown in the drawing

AREA 2 = void area shown in the drawing

AREA 3 = jacket area compressed by each outer strand as shown in drawing

Since $\frac{1}{2}$ AREA 3 is relatively small, it can be said that the ratio between the compressed cross-sectional area of each worming and the void area delimited by one outer strand, a worming and the core is substantially between 0.5 and 3.

The worming 16 is preferably made of fibrous material such as nylon, but can also be made of plastic rods of suitable hardness, including plastic rods impregnated with lubricants.

The use of wormings allows the manufacturing of ropes with a controlled, preset uniform strand gap "d". Good control of the strand gaps is essential to ensure an extended rope life and to minimize interstrand fretting corrosion. The jacketing of the core to a thickness between 0.035" and 0.060" adequately protects the core from the pressure and abrasion of the outer strands while sealing its lubricant. The core jacket does not any more have to be thick enough so as to provide sufficient material to space away the outer strands.

It is generally known to provide spacers between the outer strands of a wire rope as disclosed in U.S. Pat. No. 4,509,319 granted Apr. 9, 1985. However, the wire rope disclosed in the above patent is not plastic jacketed and therefore fails to disclose any solution to applicants' problem of protecting in a positive way the core of a wire rope from the pressure and abrasion of its outer strands while sealing its lubricant, and at the same time providing a controlled preset uniform gap between the outer strands to ensure an extended rope life.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A method for making a wire rope comprising a core; a plastic jacket placed over the core; a plurality of outer strands laid on the circumference of said jacketed core; and a plurality of substantially round wormings, the method comprising the steps of:

i) extruding the plastic jacket over the core;

ii) simultaneously laying on the circumference of the jacketed core a plurality of loose and substantially round wormings, and a plurality of outer strands, in such a manner that the wormings are compressed by the outer strands to substantially fill the voids comprised between two adjacent outer strands and the core.

2. A method according to claim 1, wherein the thickness of the jacket is from 0.035" to 0.060".

3. A method according to claim 1, wherein the size of the wormings provides a ratio of from 0.5 to 3 between their compressed cross-sectional area and the void area formed between a strand, a worming and the core.

4. A method according to claim 1, wherein the core is selected from the group consisting of an independent wire rope core (IWRC), a wire strand core, and a fibre core.

5. A method according to claim 1, wherein the wormings are made of fibrous material.

6. A method according to claim 1, wherein the wormings are made of plastic rods.

7. A method according to claim 6, wherein the plastic rods are impregnated with lubricants.

8. A method according to claim 1, wherein the plastic material of the jacket is selected from the group consisting of polyethylene, polypropylene and nylon.

* * * * *